US005231959A

United States Patent [19]

Smietana

[11] Patent Number: 5,231,959

[45] Date of Patent: Aug. 3, 1993

[54] INTAKE OR EXHAUST VALVE ACTUATOR

[75] Inventor: James M. Smietana, West Seneca, N.Y.

[73] Assignee: Moog Controls, Inc., East Aurora, N.Y.

[21] Appl. No.: 991,134

[22] Filed: Dec. 16, 1992

[51] Int. Cl.[5] ..... F01L 9/02

[52] U.S. Cl. ..... 123/90.12; 123/90.15; 123/90.24; 123/90.51

[58] Field of Search ..... 123/90.12, 90.13, 90.15, 123/90.16, 90.19, 90.24, 90.48, 90.51

[56] References Cited

U.S. PATENT DOCUMENTS

| | | | |
|---|---|---|---|
| 3,090,367 | 5/1963 | Ayres | 123/90.51 |
| 3,291,107 | 12/1966 | Cornell | 123/90.51 |
| 3,301,240 | 1/1967 | Peresada | 123/90.51 |
| 4,200,067 | 4/1980 | Trenne | 123/90.13 |
| 4,484,545 | 11/1984 | Madsen | 123/90.12 |
| 4,643,144 | 2/1987 | Fingerle et al. | 123/90.49 |
| 4,930,464 | 6/1990 | Letsche | 123/90.12 |

FOREIGN PATENT DOCUMENTS

| | | | |
|---|---|---|---|
| 676741 | 7/1979 | U.S.S.R. | 123/90.13 |

*Primary Examiner*—E. Rollins Cross
*Assistant Examiner*—Weilun Lo
*Attorney, Agent, or Firm*—Wall and Roehrig

[57] ABSTRACT

A hydraulic intake or exhaust valve actuator for an internal combustion engine has a generally cylindrical sleeve, a piston member formed with a head portion and a rod or shaft portion, and a rod bearing through which the rod portion slides axially. To accommodate wide temperature variations, the sleeve, piston member, and rod bearing, are all formed of the same material so as to have similar thermal expansion coefficients. Outer surfaces of the piston member head portion and rod portion are provided with a coating of titanium nitride, while corresponding inner surfaces of the sleeve and the rod bearing are provided with a hard coating of a different material, e.g. nickel boride. These coatings have different hardnesses, so that galling or adhesive contact is avoided.

6 Claims, 2 Drawing Sheets

INTAKE OR EXHAUST VALVE ACTUATOR

BACKGROUND OF THE INVENTION

This invention relates to hydraulic actuators, and is more particularly concerned with piston type actuators employed at high frequencies and where quick response is required. The invention is more specifically directed to actuators for opening and closing intake and/or exhaust valves for internal combustion engines.

It has been recently proposed to employ hydraulic valve actuators in diesel and gasoline engines to replace the conventional system of camshaft, cams and rocker arms.

In the hydraulically actuated system, hydraulic actuators are associated with each of the intake and exhaust valves. Each actuator fits into a respective socket or receptacle in the engine cylinder head, which is in the form of an aluminum block with chambers, bores, and passages for the hydraulic oil to flow to and from these actuators. A timing wheel turns synchronously with the engine crank shaft (once for every two crank turns in the case of a standard four-stroke engine). A sensor measures the wheel position and determines the crankshaft position, that is the phase of the various pistons as they oscillate in their respective cylinders or combustion chambers. The sensor is connected to a timing circuit that sends pulse width modulated (PWM) signals to each of the solenoid valves. The latter each open or close to send fluid pressure to the associated actuator and thus open or close it intake or exhaust valve in accordance with the piston phase.

With this system, it is possible to adjust valve timing on the fly by adjusting the timing and shape of the PWM signals from the timing circuit.

However, because of the sustained high speeds (operating rate of 50 Hz at an engine speed of 6000 RPM) and the precision needed for timing of the valves, certain problems arise in the construction and operation of the actuators.

Because the actuators must operate over a wide range of operating conditions in which the temperature can vary by 300 degrees F., but close tolerance must be maintained, all major parts of the actuator must be made of the same material (usually steel) so that all the elements have substantially the same coefficient of thermal expansion. However, if sliding contacting parts, i.e., the piston and the rod bearing, both are formed of the same metal then there is a significant risk of adhesive wear, i.e., galling.

The conventional approach to this problem of galling is to provide a coating of a soft metal, such as copper, on one or the other of the surfaces in sliding contact. This technique as applied to a high-performance spool valve is described in U.S. Pat. No. 4,337,797. Providing the opposing sliding surfaces with widely varying hardnesses avoids adhesive contact such as galling.

However, in applications where there is heavy-duty service and high-velocity motion of the sliding parts, damage occurs to the soft copper surfaces caused by localized cavitation. The cavitation results in erosion of the copper. The erosion exposes the underlying steel body of the unit and permits direct contact with the sliding spool or piston within. This brings about galling at high velocities.

Cavitation occurs when, because of quick piston movement, the fluid pressure in a localized area falls below the vapor pressure of the fluid. This can result in evaporation of the liquid film layer that normally is found between the piston and cylinder cavity and between the rod and the rod bearing. In the absence of this liquid film, direct metal contact can occur. Then normal piston motion can wear away the soft metal coating.

Because of this characteristic, the copper plated hydraulic actuator is poorly suited for use in applications such as with the intake or exhaust valve of an internal combustion engine where the piston must be driven at high velocities and at high frequency for extended periods.

Consequently, the industry has sought a hydraulic actuator which can be employed in this environment and which avoids the above-noted problems attributed to cavitation and galling.

OBJECTS AND SUMMARY OF THE INVENTION

It is an object of this invention to provide a high-performance, high-speed hydraulic actuator suitable for use with the intake or exhaust valve of an internal combustion engine.

It is another object to provide a hydraulic actuator which can enjoy a prolonged, rough service life, with a reduced risk of failure.

It is a further object to provide the actuator with hard, wear-resistant sliding surfaces that avoid erosion.

According to an aspect of this invention, an actuator for an intake or exhaust valve of a internal combustion engine is especially adapted for opening and closing the respective valve, e.g. to admit intake gas from the intake manifold into the combustion chamber of the associated cylinder or to permit exhaust gases to escape from the combustion chamber into the exhaust manifold. A timing wheel is coupled e.g. by a timing chain or timing belt to the engine crankshaft. A sensor, which can be magnetic or optical for example, tracks the position of the timing wheel and supplies a signal to a timing circuit, and the latter generates a pulse width modulated (PWM) signal for opening and closing each respective valve. The PWM signal is furnished to a three-way solenoid valve which has inputs connected to a pressure source and a drain or return line and an output connected to the actuator.

The actuator has three basic components, namely a generally cylindrical sleeve which defines a cylindrical cavity; a piston member which includes a head portion that slidably fits in the cylindrical cavity and a rod portion that protrudes out a distal end of the sleeve; and a rod bearing positioned at the distal end of the sleeve with a cylindrical bore through which the rod portion passes, to guide the piston rod portion and form a fluid seal around the rod. Because the actuator has to operate over a wide temperature range, the sleeve, the piston member and the rod bearing all are formed of the same material (steel) so they all have similar thermal expansion characteristics.

The sleeve has at least one distal port and at least one proximal port for communicating fluid pressure to the piston head inside the sleeve. The distal port is connected to a hydraulic pressure supply so there is always pressure on the distal or rod side of the piston. The proximal port is connected to the control port of the associated solenoid valve, so that when the valve is in its actuated position hydraulic pressure is applied to the proximal side of the piston and in its unactuated position low or drain pressure appears there. Because of the effective cross section occupied by the rod portion of the piston member, the proximal side of the piston head has about twice the effective area as the distal side. Thus, when the solenoid valve is actuated, the piston member moves distally to open the intake or exhaust valve. Because the distal port is always connected to hydraulic pressure, when the solenoid valve is deactuated, pressure is relieved and the piston member returns proximally to close the associated valve.

Preferably, there are additional cushioning ports positioned beyond the associated proximal and distal ports to limit fluid flow near the ends of the actuator stroke. This slows down the piston member and the intake or exhaust valve as it approaches its respective seat.

In order to prevent galling of the actuator moving parts, the piston head portion and the rod portion are provided with a thin coating of a hard material, namely titanium nitride at a suitable thickness between about 40 and 200 microinches. The mating surfaces of the sleeve cylindrical cavity and the rod bearing bore are given a coating of another hard material, e.g. boron nitride, also of about the same thickness. Both materials are harder and thus more wear resistant than the underlying steel. The titanium nitride coating on the piston member has a Knoop hardness of about 1245 (this corresponds approximately to a Rockwell C hardness of about 89–90). The coating of the sleeve and or bearing has a Knoop hardness of about 1105 (corresponding to Rockwell C 79–80), so there is a hardness differential of about 140 Knoop or about 10 Rockwell C. The hardness differential prevents adhesive contact, and the smooth, hard coatings also avoid cavitation under heavy-duty, high-speed operation. The titanium nitride has a good natural lubricity which also serves to combat wear.

The thickness of the coatings is generally governed by plating considerations, and the thickness is not critical for this invention.

Both the nickel boride and titanium nitride also provide a modest degree of corrosion protection.

The above and many other objects, features and advantages of this invention will become apparent from the ensuing description of a preferred embodiment, which should be read in conjunction with the accompanying Drawing.

DETAILED DESCRIPTION OF THE PREFERRED EMBODIMENT

Figure 1:
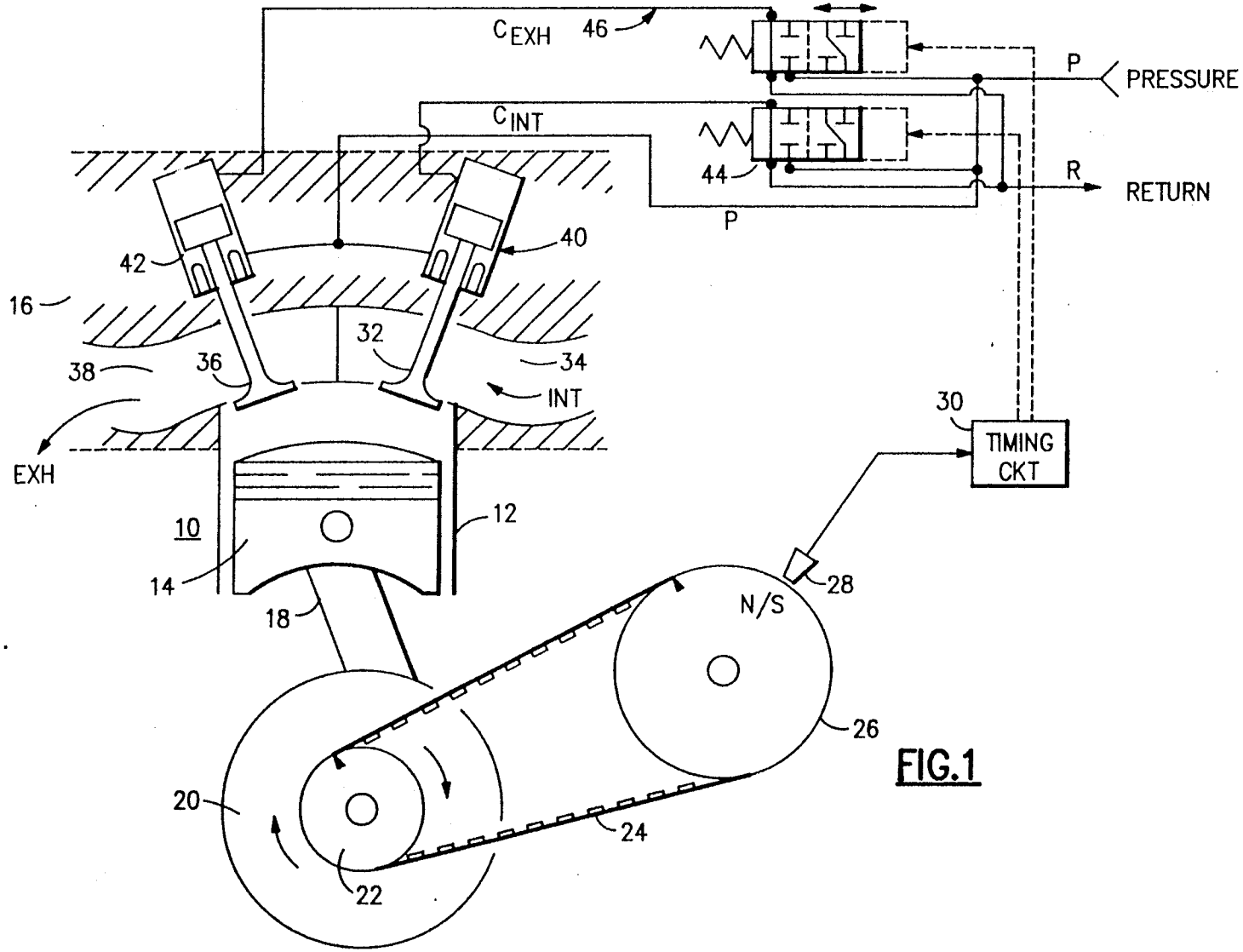
FIG. 1 is a schematic view of an internal combustion engine including hydraulic intake and exhaust valve actuator assemblies in accordance with one embodiment of the invention.

With reference to the Drawing, FIG. 1 shows schematically an internal combustion engine 10 which incorporates the improved valve actuator mechanism of the present invention. In this engine 10 a cylinder 12 is shown in which a piston 14 oscillates up and down. The engine can contain any number of cylinders, e.g. 4, 6, 8, or 12 cylinders, although here only one cylinder is shown to illustrate the principles of the invention. A cylinder head 16 is attached onto the engine at an upper end of the cylinder to enclose the piston 14 and define a respective combustion chamber. The connecting rod 18 extends from a wrist pin of the piston 14 to a crank (not shown) which is disposed behind a flywheel 20. On the same shaft is a timing pulley 32 from which a timing belt 24 drives a timing wheel 26 which rotates once for each two revolutions of the timing pulley 22. A sensor 28, which can be magnetic or optical, as desired, senses the position of the timing wheel 26 and provides an electrical indication to a timing circuit 30, which provides for each cylinder 12 a pulse width modulated (PWM) signal with rising and falling edges at a predetermined phase of the oscillating piston 14. The PWM signals actuate an intake valve 32 that admits intake or combustion gases from an intake conduit 34 into the combustion chamber, and an exhaust valve 36 that releases the exhaust combustion gases from the combustion chamber out into a exhaust conduit 38. Associated with each of the intake and exhaust valves 32, 36, there is a respective hydraulic actuator 40 and 42. In principle, these hydraulic actuators are of the same basic construction, but can vary somewhat as to bore and stroke characteristics because of engineering considerations for the respective intake and exhaust valves. The intake hydraulic actuator 40 is coupled through bores and conduits that are provided in the cylinder head 16 to a intake three-way solenoid valve 44, and an exhaust valve actuator 42 is similarly connected to an exhaust three-way solenoid valve 46. A distal end of each of the actuators 40, 42 is continuously coupled to a source of hydraulic pressure P, typically 150 psig. A proximal end of the actuator 40 or 42 is connected to the respective control output $C_{int}$ or $C_{exh}$ of the associated three-way valve 44, 46. The solenoid valves 44, 46 are driven by respective PWM signals from the timing circuit 30 to couple the control outputs $C_{exh}$ and $C_{int}$ alternately between the pressure source P and a hydraulic return line R.

Figure 2:
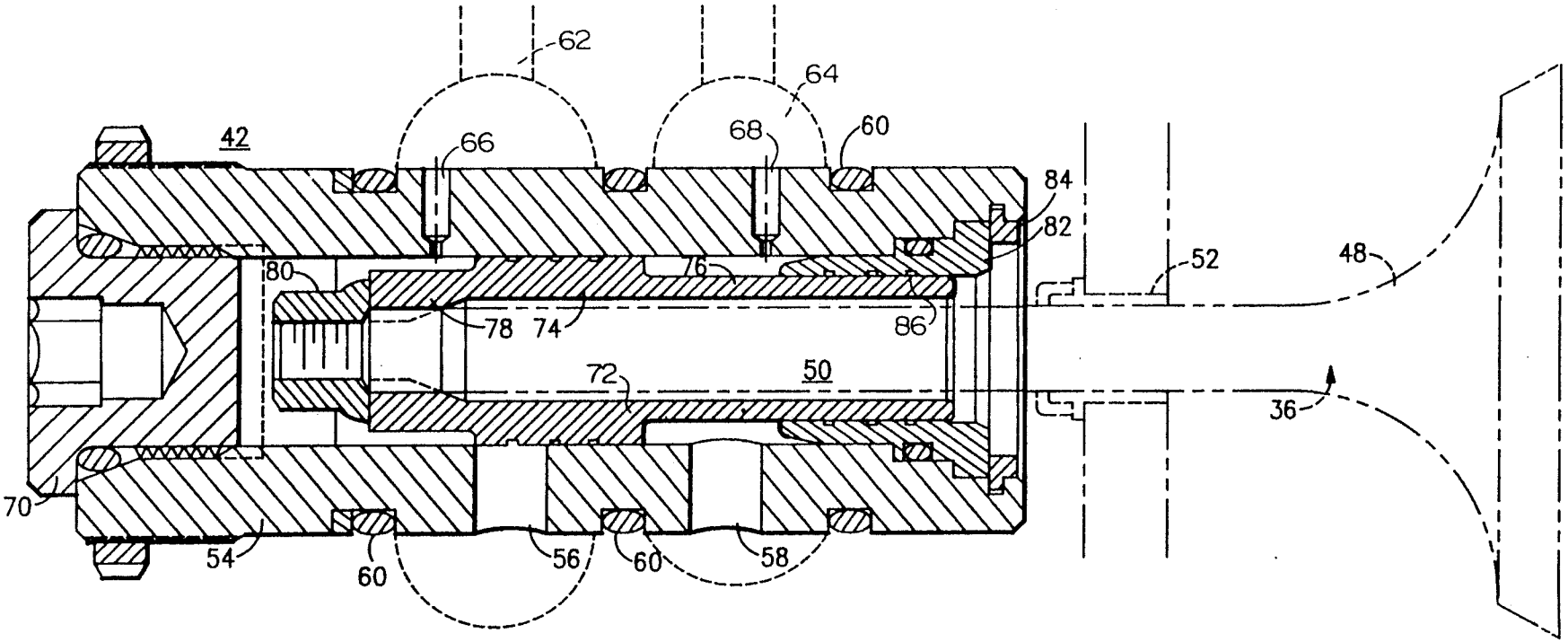
FIG. 2 is a sectional view of the intake or exhaust valve actuator of the preferred embodiment.

Details of the exhaust hydraulic actuator 42 are shown in FIG. 2, which also shows that the exhaust valve 36 is comprised of a valve head 48, a valve stem 50 which projects proximally into the actuator 42, and a seal 52 disposed over the valve stem 50. The actuator 42 has a body or sleeve 54 in the form of a steel cylinder having a cylindrical bore or cavity. A control port 56 extends through the wall of the sleeve 54 and a pressure port 58 is positioned distally of the control port 56. Ring seals 60 provided on an outer wall of the sleeve 54 fit against corresponding structure within the cylinder head 16 and separate a respective control conduit 62 and pressure conduit 64. The latter couple the control port 56 and pressure port 58 respectively to the solenoid valve 46 and to the hydraulic pressure source P. In order to slow down piston motion at the end of the actuator stroke, there are a cushioning port 66 proximally of control port 62 and cushioning port 68 distally of the pressure port 64, each of which includes a metered aperture to limit hydraulic fluid flow.

An end plug 70 closes off the proximal end of the sleeve 54.

A piston member 72 has a head portion 74 formed of a series of annular lands separated or spaced by annular grooves. The head portion 74 has an outer diameter that mates with the inner cylindrical surface of the sleeve 54 and slidably contacts the same. A rod or shaft portion 76 of the piston member is of smaller diameter than the head portion, here about one half the cross sectional area of the head portion. The rod portion has a smooth cylindrical outer surface and a bore extending axially therethrough. The stem 50 of the valve penetrates through this bore, and also through the head portion 74, and is secured between a shoulder 78 near the proximal end of the piston member and a self-locking nut 80 that is positioned on a threaded proximal end of the valve stem 50.

A rod bearing 82 is disposed at the distal end of the sleeve 54 and is held in place by a retaining ring 84. The rod bearing has annular internal lands 86 that define a generally cylindrical passageway for the piston member shaft portion 76 and slidably contact the same for guiding the piston member 72 and the associated exhaust valve 36 proximally-distally.

The sleeve 54, piston member 72, and rod bearing 82 are all made of the same material, namely a heavy duty steel, because all require the same thermal coefficient of expansion. However, because of galling problems, and to address cavitation and lubricity problems, the outer surfaces of the piston member head portion 74 and shaft portion 76 are provided with a coating of titanium nitride, to a thickness of about 40 to 200 microinches, and preferably at about 80 microinches. This can be applied by a conventional physical vapor deposition (PVD) technique. The titanium nitride provides a smooth, hard, wear resistant surface with a high natural lubricity. The inner surfaces of the cylindrical cavity of the sleeve 54 and of the bore or passageway of the rod bearing 82 are provided with a coating of a different hard material, preferably nickel boride of a similar thickness. It should be noted that the thicknesses of these coatings are not critical, but are dictated by coating or other engineering considerations. The titanium nitride has a surface hardness of 1245 Knoop, which corresponds approximately to a Rockwell C hardness of 89 to 90. The nickel boron coating has a Knoop hardness of about 1105 corresponding to a Rockwell C hardness of about 79–80. A differential hardness, in this case of about 140 Knoop or 10 Rockwell C, avoids galling or other adhesive contact of the mating sliding surfaces.

With the hydraulic actuators as described here, a very long service at high frequency under heavy duty conditions can be realized. Because hydraulic valve actuation can actually be achieved, the conventional engine parts such as cam shaft, rocker arms, and valve lifters can be eliminated. Also, valve timing can be adjusted on the fly, that is, during engine operation to accommodate changing requirements of torque, power, fuel economy, and emission control, by electrically adjusting the timing and width of the PWM signal from the circuit 30. Also, the internal combustion engine 10 described here is offered as an example. However, there could be two or more intake valves 32 or exhaust valves 36 per cylinder. Moreover, the exhaust and intake valve actuators of this invention can be applied to diesel engines, two-stroke engines, rotary piston engines (Wankel engines) or to actuate the fuel injector or other mechanism of an internal combustion engine where there is a requirement for heavy duty and high frequency operation.

While this invention has been described in detail with respect to a preferred embodiment, it should be understood that the invention is not limited to that embodiment. Rather, many modifications and variations would present themselves to those of skill in the art without departing from the scope and spirit of this invention, as defined in the appended claims.

What is claimed is:

1. Intake or exhaust valve actuator assembly for an internal combustion engine for hydraulically opening and closing an associated intake or exhaust valve for admitting intake gasses from an intake conduit into a combustion chamber or permitting exhaust gases to escape from said combustion chamber into an exhaust conduit, the engine including a piston which oscillates in said combustion chamber, a cylinder head which encloses said combustion chamber and contains said intake or exhaust valve and said intake or exhaust conduit, and timing means to detect phase of said piston as it oscillates in said combustion chamber; said intake or exhaust valve having a valve head which mates with a seat in said cylinder head and a stem that protrudes into said cylinder head; said intake or exhaust valve actuator assembly comprising a sleeve mounted in said cylinder head, the sleeve having a cylindrical cavity, a piston member slidably disposed in said sleeve cylindrical cavity including a piston head portion having a generally cylindrical face engaging an inner wall of said sleeve cylindrical cavity and a rod portion extending from said head portion out a distal end of said sleeve, said piston member being affixed onto the stem of the associated intake or exhaust valve, and a rod bearing member mounted in the distal end of said sleeve for guiding said rod portion and forming a sliding seal therewith, said sleeve, said piston member and said rod bearing member being formed of a suitable material, and said sleeve having a distal port and a proximal port formed therein for communicating fluid pressure to said cylindrical cavity respectively distally and proximally of said piston member head portion; and hydraulic valve means actuated by said timing means and coupled to said distal and proximal ports to apply fluid pressure to at least one of said ports to move said piston member and open and close the associated intake or exhaust valve in accordance with the detected phase of the piston of the engine; and wherein said actuator assembly piston member is provided with a coating of titanium nitride on the cylindrical face of said head portion and on said rod portion, and wherein the mating surfaces of said sleeve cylindrical cavity and said rod bearing member are provided with a coating of a hard material of a lower hardness than said titanium nitride so that there is a differential hardness on the order of about 140 Knoop to reduce risk of galling between the piston member and the sleeve and the rod bearing member.

2. The valve actuator assembly of claim 1 wherein the same suitable material is employed for said sleeve, said piston member and said rod bearing member so that they all have substantially the same thermal expansion coefficient thereby accommodating a wide operating temperature range.

3. The valve actuator assembly of claim 2 wherein said suitable material is steel.

4. The valve actuator assembly of claim 1 wherein said titanium nitride coating has a thickness between 50 and 200 microinches.

5. The valve actuator assembly of claim 1 wherein said other material is a plating of nickel boride.

6. The valve actuator assembly of claim 1 wherein said sleeve further includes first and second cushioning ports hydraulically coupled to said proximal and distal ports and positioned respectively proximally and distally thereof on the sleeve, said cushioning ports including flow limiting means reducing the speed of said piston member at proximal and distal ends of its stroke.

* * * * *